US008341999B2

(12) United States Patent
Hirano

(10) Patent No.: US 8,341,999 B2
(45) Date of Patent: Jan. 1, 2013

(54) TERMINAL AND METHOD FOR PRODUCING THE SAME

(75) Inventor: Kazuhiro Hirano, Kyoto (JP)

(73) Assignee: OMRON Corporation, Kyoto (JP)

( * ) Notice: Subject to any disclaimer, the term of this patent is extended or adjusted under 35 U.S.C. 154(b) by 310 days.

(21) Appl. No.: 12/294,153

(22) PCT Filed: Mar. 26, 2007

(86) PCT No.: PCT/JP2007/056236

§ 371 (c)(1),
(2), (4) Date: Sep. 23, 2008

(87) PCT Pub. No.: WO2007/116691

PCT Pub. Date: Oct. 18, 2007

(65) Prior Publication Data

US 2009/0104798 A1 Apr. 23, 2009

(30) Foreign Application Priority Data

Mar. 27, 2006 (JP) ..... 2006-085752

(51) Int. Cl.
*B21D 37/08* (2006.01)
*H01R 43/00* (2006.01)

(52) U.S. Cl. ..... 72/416; 72/338; 29/874

(58) Field of Classification Search ..... 72/324, 72/326, 416, 414, 325, 331, 337, 338, 464, 72/470; 29/874, 414
See application file for complete search history.

(56) References Cited

U.S. PATENT DOCUMENTS

| | | | | |
|---|---|---|---|---|
| 3,485,079 | A * | 12/1969 | Bogaert | 72/376 |
| 4,795,378 | A | 1/1989 | Tomizu et al. | |
| 4,799,589 | A | 1/1989 | Peleckis | |

FOREIGN PATENT DOCUMENTS

| | | | |
|---|---|---|---|
| DE | 3633096 | A1 | 3/1988 |
| DE | 4022965 | C1 | 7/1991 |
| EP | 0621657 | A2 | 10/1994 |
| EP | 0716479 | A2 | 6/1996 |
| JP | 51-93960 | | 7/1976 |
| JP | 59-3478 | | 1/1984 |
| JP | 62-159938 | | 10/1987 |

(Continued)

OTHER PUBLICATIONS

English translation of the International Preliminary Report on Patentability (Chapter I) and Written Opinion of the International Searching Authority for International Application No. PCT/JP2007/056236, International Filing Date: Mar. 26, 2007, 7 pages.

(Continued)

*Primary Examiner* — Debra Sullivan
(74) *Attorney, Agent, or Firm* — Osha Liang LLP

(57) ABSTRACT

A method for producing a terminal has the steps of disposing butt surfaces of a pair of forming dies and side surfaces of a linear conductive material having a square shape in cross section parallel to one another, forming cutting recesses on ridge lines of the linear conductive material by first pressing surfaces, each provided on each of the butt surfaces, forming tapered surfaces continuous with the cutting recesses by second pressing surfaces, each formed by cutting at least one side edge portion of the first pressing surface, and cutting the cutting recesses so that a unit-length terminal is cut out.

3 Claims, 5 Drawing Sheets

FOREIGN PATENT DOCUMENTS

| | | | |
|---|---|---|---|
| JP | 63-54273 | | 4/1988 |
| JP | 2-38144 | | 3/1990 |
| JP | 02075429 | A | 3/1990 |
| JP | 2579538 | B2 | 11/1996 |
| JP | 9-245930 | | 9/1997 |

OTHER PUBLICATIONS

Patent Abstracts of Japan, Publication No. 09-245930 dated Sep. 19, 1997, 1 page.
Patent Abstracts of Japan, Publication No. 02-098084 dated Apr. 10, 1990, 1 page.
International Search Report issued in PCT/JP2007/056236, mailed on Apr. 24, 2007, with translation (4 pages).
Partial English translation of JP59-3478U, Publication Date: Jan. 10, 1984, 1 page.
Partial English translation of JP2-38144U, Publication Date: Mar. 14, 1990, 2 pages.
Partial English translation of JP51-93960U, Publication Date: Jul. 28, 1976, 1 page.
Partial English Translation of JP62-159938U, Publication Date: Oct. 12, 1987, 1 page.
Notice of Office Action for related Japanese Patent Application No. 2006-085752, dated Jul. 6, 2010, and English translation thereof, 7 pages.
Chinese Office Action for Patent or Application No. 200780011617.1, dated Jun. 24, 2010, with english translation hereto, 8 pages.
Extended European Search Report for Application No. 07739674.5 dated Dec. 16, 2011 (7 pages).
European Patent Abstract for Japanese Publication No. 02075429 Published Mar. 15, 1990 (1 page).

* cited by examiner

Prior Art

TERMINAL AND METHOD FOR PRODUCING THE SAME

TECHNICAL FIELD

The present invention relates to a terminal, in particular to a conducting terminal that is cut out from a linear conductive material having a square shape in cross section, and a method for producing the same.

BACKGROUND ART

Conventionally, as a terminal, for example, there is one in which a pin contact 1 is press fitted into a terminal hole 5 in a base 4 and the like so as to prevent it from coming off as shown in FIG. 5. In such a pin contact 1, a tapered surface 3 is formed between ridge lines 2, 2 so as to prevent the pin contact 1 from scraping off an inner peripheral surface of the terminal hole 5 when the pin contact 1 is press fitted thereinto. In order to form the pin contact 1, there is a pin contact processing device in which pin contacts 1 are cut out from a pin contact wire 6 by forming dies 7*a*, 7*b* and 8*a*, 8*b* that are alternately butted against the pin contact wire 6 as shown in FIG. 5D (refer to Patent Document 1).

Patent Document 1: Registered Patent Gazette No. 2579538

DISCLOSURE OF INVENTION

Problem to be Solved by the Invention

However, in a case where unit-length pin contacts 1 are cut out from a pin contact wire 6 by the pin contact processing device, it is necessary that tapered surfaces 2 forming quadrangular pyramids, each tapered surface formed between adjacent ridge lines 2, 2 of the pin contact wire 6, are formed by the forming dies 7*a*, 7*b* and 8*a*, 8*b* that are butted against the pin contact wire 6 and then the pin contacts 1 are cut out. Therefore, since each pin contact 1 has a small effective winding region to which a coil wire can be tied up, it is necessary to provide an extra length to the total length of the pin contact 1 resulting in a waste of material.

Further, in the case where unit-length pin contacts 1 are cut out from a pin contact wire 6, at least three steps are required, so that the number of production steps is large and the productivity is low.

In view of the above problem, it is an object of the present invention to provide a terminal which makes it possible to save material, has a small number of production steps and high productivity, and a method for producing the same.

Means of Solving the Problem

In order to solve the above problem, there is provided a terminal of the present invention wherein end portions of ridge lines of a linear conductive material having a square shape in cross section are each formed with a tapered surface.

Effect of the Invention

According to the present invention, by only forming the tapered surfaces respectively at the end portions of the ridge lines of the linear conductive material having the square shape in cross section, an inner peripheral surface of a terminal hole is not scraped off. Together with that, in a case where a coil wire is tied up, for example, an effective winding region is large and a terminal can be formed with a minimum necessary length, so that material can be saved.

In an embodiment of the present invention, the tapered surface may be formed so as to be annularly continuous.

According to the present embodiment, since a terminal hole is enlarged with the annular tapered surface, a terminal that is smoother in press fitting work is obtained.

In another embodiment of the present invention, a tip end surface may be provided with a column-shaped protrusion.

According to the present embodiment, since the terminal can be positioned by inserting its cylindrical protrusion into a terminal hole, press fitting work is facilitated.

A method for producing a terminal of the present invention comprises the steps of:

disposing butt surfaces of a pair of forming dies and side surfaces of a linear conductive material having a square shape in cross section parallel to one another;

forming cutting recesses on ridge lines of the linear conductive material by first pressing surfaces, each provided on each of the butt surfaces;

forming tapered surfaces continuous with the cutting recesses by second pressing surfaces, each formed by cutting at least one side edge portion of the first pressing surface; and cutting the cutting recesses so that a unit-length terminal is cut out.

According to the present invention, a terminal can be cut out by two steps of work by using a pair of forming dies and cutting work, so that a highly productive method for producing a terminal is obtained.

An embodiment of the present invention may comprise the steps of:

disposing butt surfaces of a pair of forming dies and side surfaces of a linear conductive material having a square shape in cross section parallel to one another;

forming an annular cutting recess on the linear conductive material including ridge lines by semi-circular first pressing surfaces, each provided on each of the butt surfaces;

forming an annular tapered surface continuous with the cutting recess by second pressing surfaces, each provided along at least one side edge portion of the first pressing surface; and cutting the cutting recess so that a unit-length terminal is cut out.

According to the present embodiment, a terminal having an annular tapered surface is obtained, so that press fitting work is facilitated more.

Another embodiment of the present invention may comprise the steps of:

forming a cutting recess by a pair of forming dies that are butted against a central portion of a two-unit length linear conductive material having a square shape in cross section to form a cutting recess;

forming tapered surfaces continuous with the cutting recess; and cutting the cutting recess so that unit-length terminals are cut out.

According to the present embodiment, since two terminals are obtained simultaneously, there is an effect that a highly productive method for producing a terminal is obtained.

DESCRIPTION OF NUMERALS

Figure 1A:
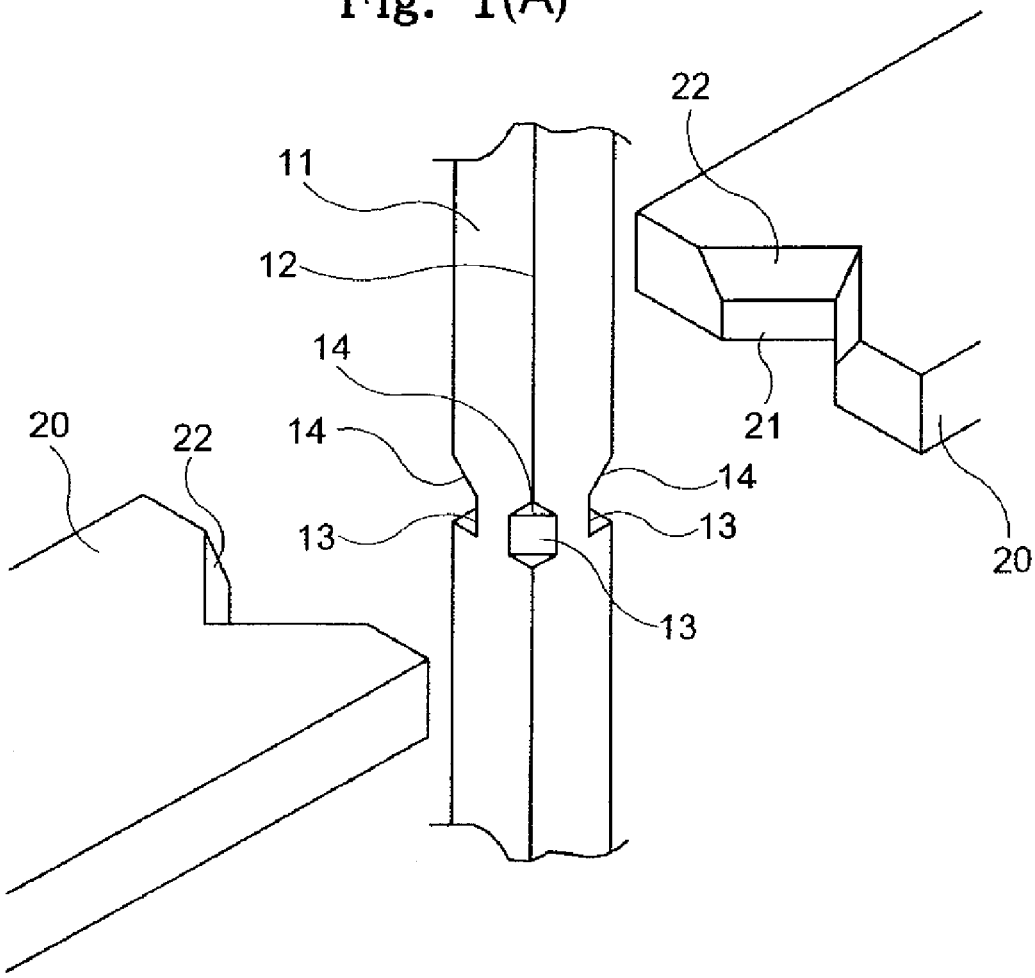
FIG. 1A is a perspective view showing a production process of a first embodiment of the present invention.

10: coil terminal
11: linear conductive material
12: ridge line
13: cutting recess
14: tapered surface
15: tip end surface
16: column-shaped protrusion
20: forming die
21: first pressing surface
22: second pressing surface

BEST MODE FOR CARRYING OUT THE INVENTION

Embodiments of the present invention will be described with reference to the accompanying drawings of FIGS. 1 to 4.

A first embodiment is a case where a pair of forming dies 20, 20 are butted against predetermined positions of a linear conductive material 11 having a square shape in cross section, whereby a coil terminal 10 in which a tapered surface 14 is provided for each ridge line 2 in a discontinuous manner is cut out as shown in FIG. 1.

The linear conductive material 11 does not necessarily have a square shape in cross section, and may have a rectangular shape in cross section. Further, the linear conductive material may be a coil material wound up on a drum or a rod material having a length of two units.

Butt surfaces of the forming dies 20, 20 are cut in a V-shape whereby first pressing surfaces 21 for forming cutting recesses 13 are provided, and an upper side edge portion of each of the first pressing surfaces 21 is cut whereby second pressing surfaces 22 for forming the tapered surfaces 14 of the coil terminal 10 are provided.

Then, the butt surfaces of the forming dies 20 and side surfaces of the linear conductive material 11 are disposed parallel to one another, and the forming dies 20, 20 are butted together, whereby the cutting recesses 13 are formed, and the tapered surfaces 14 that are continuous with the cutting recesses 13 are respectively formed on the ridge lines 12.

Figure 1B:
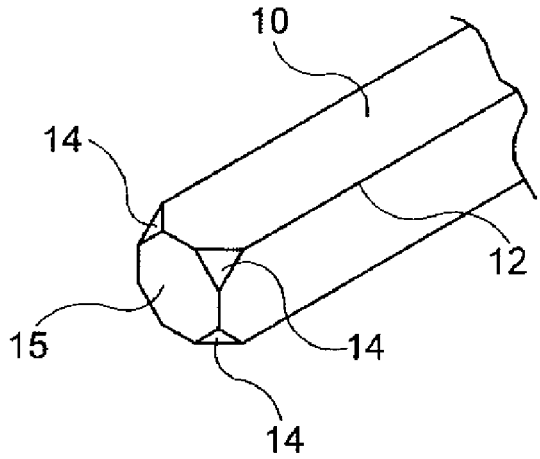
FIG. 1B is a perspective view of a coil terminal.

Thereafter, by cutting the cutting recesses 13, the coil terminal 10 shown in FIG. 1B is obtained. A tip end surface 15 of the coil terminal 10 has a roughly regular hexagonal shape, and its maximum diameter is smaller than a diameter of a terminal hole into which the coil terminal 10 is press fitted. Therefore, there is no fear that an inner peripheral surface of the terminal hole is scraped off when the coil terminal 10 is press fitted thereinto.

Further, since the cutting recesses 13 are provided, even if a cutting position is shifted a little, the shape of the tip end surface 15 of the coil terminal 10 does not greatly change, so that there is an advantage that press fitting work is not adversely affected.

Figure 2A:
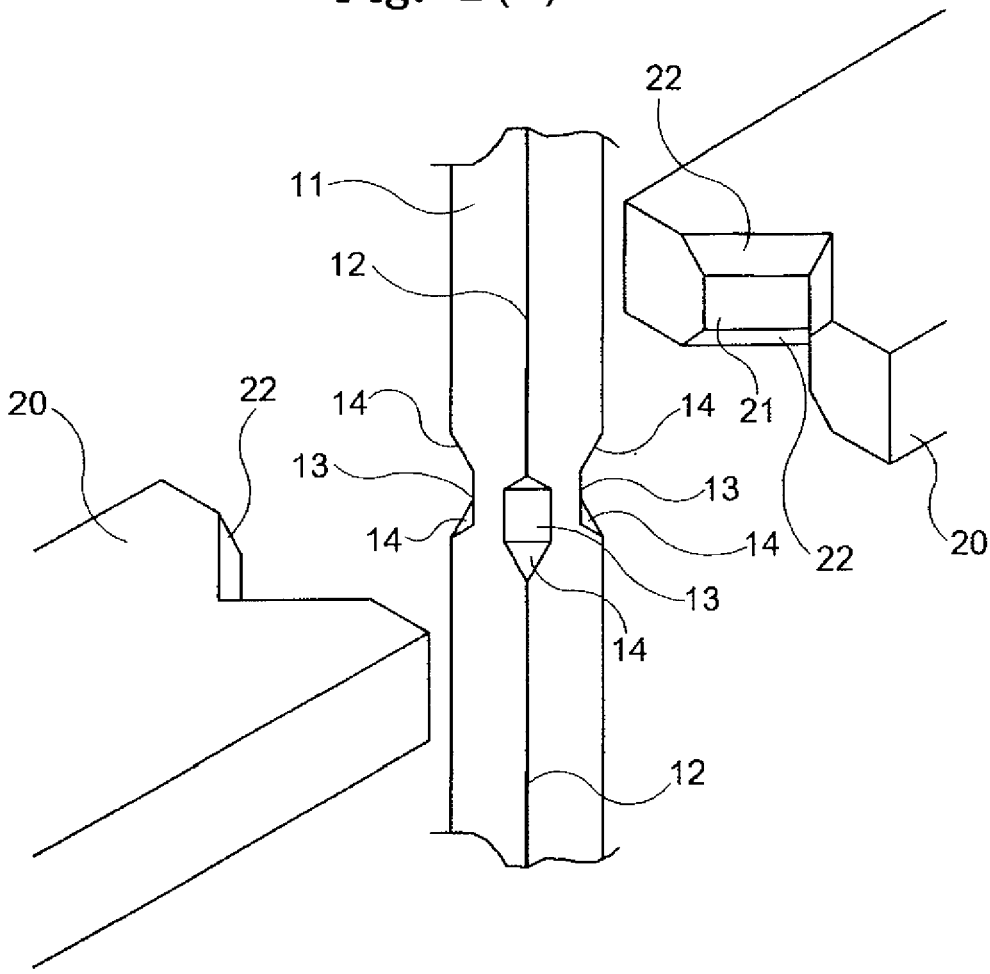
FIG. 2A is a perspective view showing a production process of a second embodiment of the present invention.

A second embodiment is a coil terminal 10 provided with a column-shaped protrusion 16 at its tip end surface as shown in FIG. 2. Similarly to the first embodiment, butt surfaces of forming dies 20, 20 for cutting out the coil terminal 10 are cut in a V-shape whereby first pressing surfaces 21 for forming cutting recesses 13 are provided. Further, upper and lower side edge portions of each of the first pressing surfaces 21 are respectively cut whereby second pressing surfaces 22 for forming tapered surfaces 14 that are continuous with the cutting recesses 13 are provided on ridge lines 12 of the coil terminal 10.

Figure 2B:
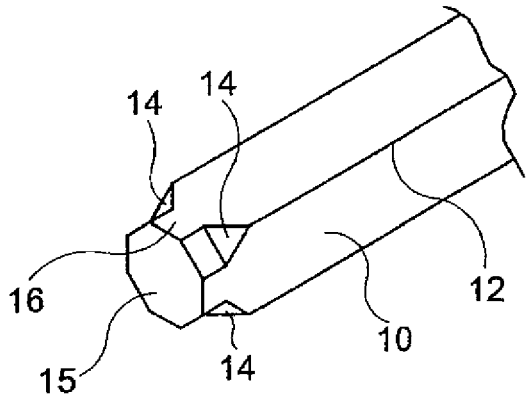
FIG. 2B is a perspective view of a coil terminal.

Then, the butt surfaces of the forming dies 20 and side surfaces of the linear conductive material are disposed parallel to one another, and the forming dies 20, 20 are butted together, whereby the cutting recesses 13 are formed, and the tapered surfaces 14 that are continuous with the cutting recesses 13 are respectively formed on the ridge lines 12. Thereafter, by cutting the cutting recesses 13, the coil terminal 10 shown in FIG. 2B is obtained.

The column-shaped protrusion 16 provided at the tip end portion of the coil terminal 10 facilitates positioning of the coil terminal when it is press-fitted into a terminal hole, so that there is an advantage that it has high assembling performance.

Figure 3A:
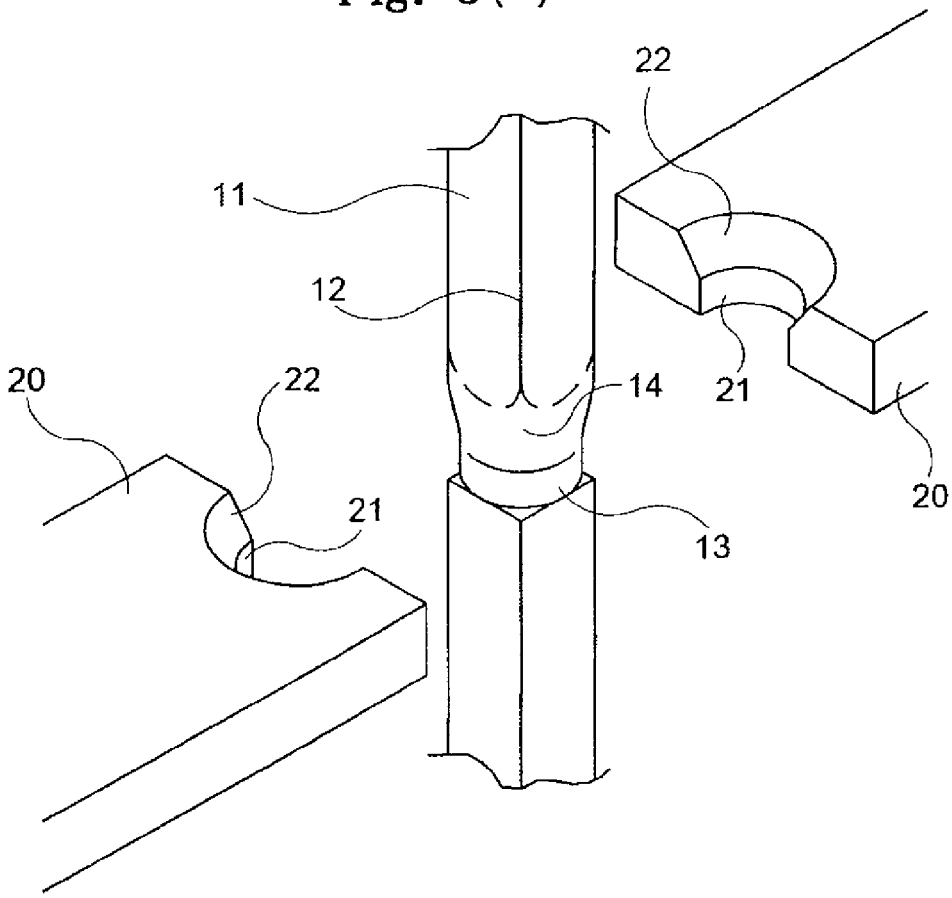
FIG. 3A is a perspective view showing a production process of a third embodiment of the present invention.

A third embodiment is a case where a coil terminal 10 having a continuous annular tapered surface 14 is formed as shown in FIG. 3. Butt surfaces of forming dies 20, 20 for cutting out the coil terminal 10 are cut in a semi-circular shape whereby first pressing surfaces 21 for forming a cutting recess 13 are provided. Further, an upper side edge portion of each of the first pressing surfaces 21 is cut whereby second pressing surfaces 22 for forming a tapered surface 14 that is continuous with the cutting recess 13 is provided.

Figure 3B:
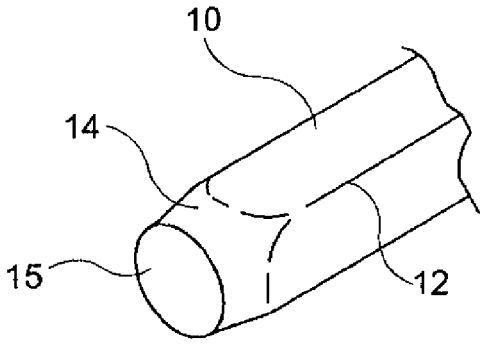
FIG. 3B is a perspective view of a coil terminal.

Then, the butt surfaces of the forming dies 20 and side surfaces of the linear conductive material 11 are disposed parallel to one another, and the forming dies 20, 20 are butted together, whereby the cutting recess 13 is formed, and the tapered surface 14 that is continuous with the cutting recess 13 is formed. Thereafter, by cutting the cutting recess 13, the coil terminal 10 shown in FIG. 3B is obtained. A tip end surface 15 of the coil terminal 10 has a circular shape, and its diameter is smaller than a diameter of a terminal hole into which the coil terminal 10 is press fitted. Therefore, there is no fear that an inner peripheral surface of the terminal hole is scraped off when the coil terminal 10 is press fitted thereinto.

Figure 4A:
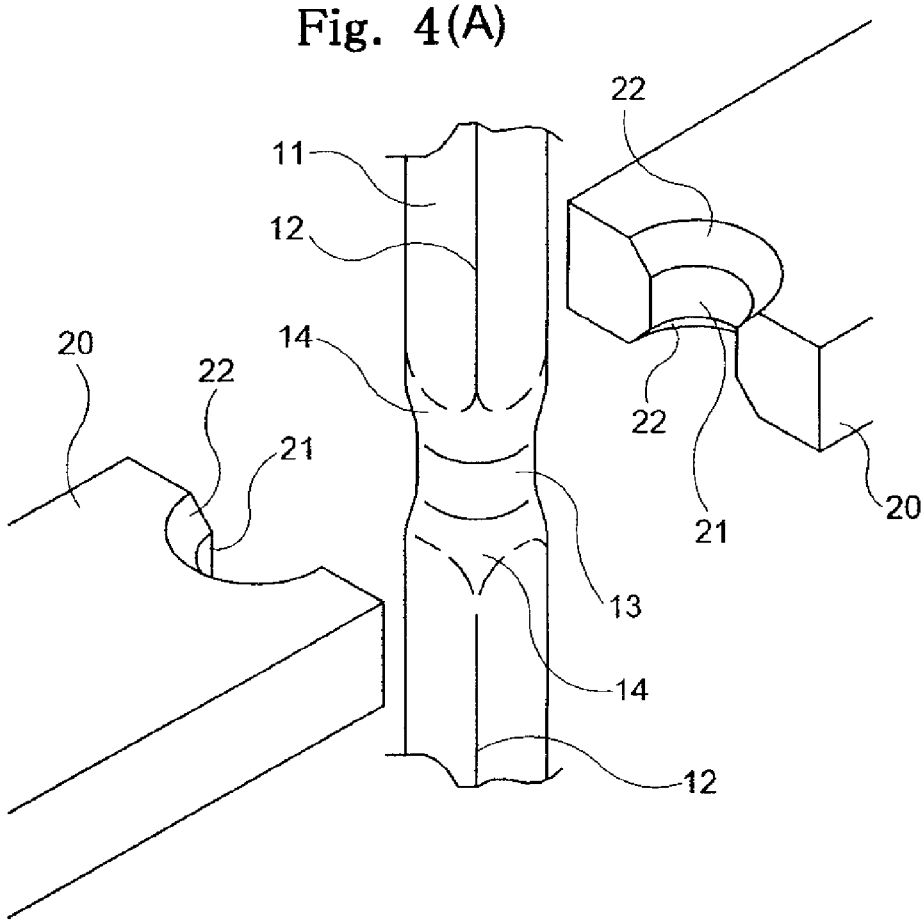
FIG. 4A is a perspective view showing a production process of a fourth embodiment of the present invention.

A fourth embodiment is a case where a coil terminal 10 provided with a cylinder-shaped protrusion 16 at its tip end portion is formed as shown in FIG. 4. Butt surfaces of forming dies 20, 20 for cutting out the coil terminal 10 are cut in a semi-circular shape whereby first pressing surfaces 21 for forming a cutting recess 13 are provided, and upper and lower side edge portions of each of the first pressing surfaces 21 are respectively cut whereby second pressing surfaces 22, 22 for forming tapered surfaces 14 that are continuous with the cutting recess 13 are provided.

Figure 4B:
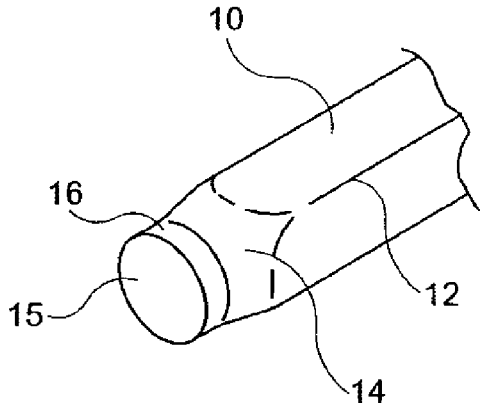
FIG. 4B is a perspective view of a coil terminal.
Figure 5:
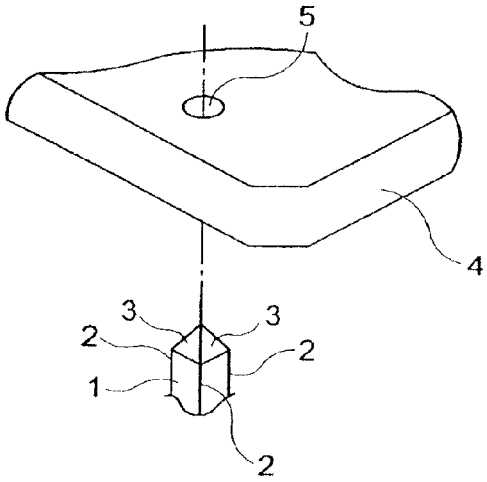
FIG. 5A and FIG. 5B are perspective views showing before assembly and after assembly, respectively, of a prior-art example.
FIG. 5C is a plan view showing sizes of a terminal hole and a coil terminal.
FIG. 5D is a perspective view showing a production process of the prior-art example.
Figure 5:
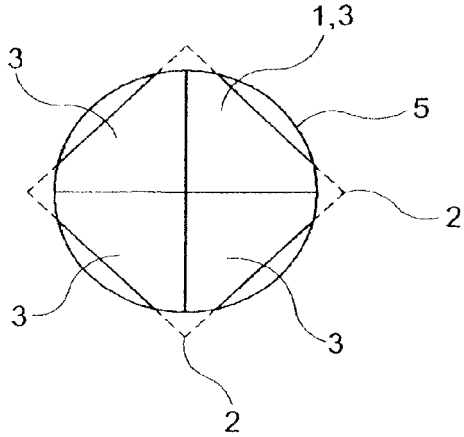
Prior Art Fig. 5 (C)
Figure 5:
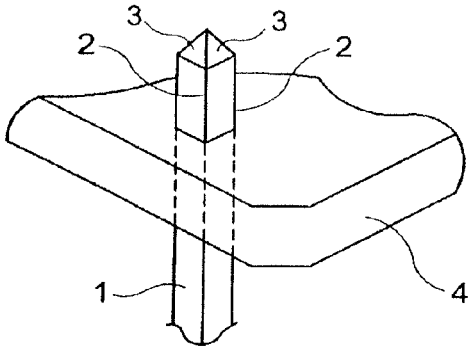
Prior Art Fig. 5 (B)
Figure 5:
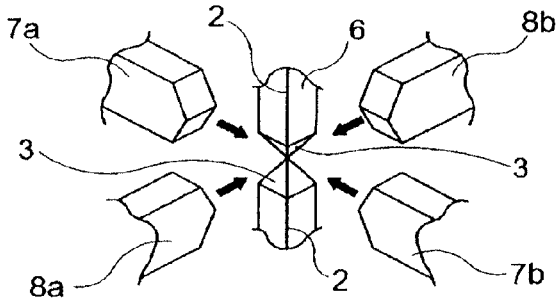
Prior Art Fig. 5 (D)

Then, the butt surfaces of the forming dies 20 and side surfaces of the linear conductive material 11 are disposed parallel to one another, and the forming dies 20, 20 are butted together, whereby the cutting recess 13 is formed, and the tapered surfaces 14 that are continuous with the cutting recess 13 are formed. Thereafter, by cutting the cutting recess 13, the coil terminal 10 shown in FIG. 4B is obtained. The cylinder-shaped protrusion 16 provided at the tip end of the coil terminal 10 facilitates positioning of the coil terminal when it is press-fitted into a terminal hole, so that there is an advantage of improving assembling performance.

INDUSTRIAL APPLICABILITY

The terminals of the present invention are not limited to the above, and may also be applied to other coil terminals or terminal pins of connectors.

The invention claimed is:

1. A method for producing a terminal comprising the steps of:

disposing butt surfaces of a pair of forming dies and side surfaces of a linear conductive material having a square shape in cross section parallel to one another;

forming cutting recesses on ridge lines of the linear conductive material by first pressing surfaces, each first pressing surface being formed by cutting out each butt surface, the first pressing surfaces being brought into line contact with the ridge lines of the linear conductive material;

forming tapered surfaces continuous with the cutting recesses by pressing second pressing surfaces of the forming die against the linear conductive material, wherein each of the second pressing surfaces is along at least one side edge portion of the first pressing surface; and cutting the cutting recesses so that a unit-length terminal having a column-shaped protrusion with a tip end surface is cut out.

2. A method for producing a terminal, comprising the steps of:

disposing butt surfaces of a pair of forming dies and side surfaces of a linear conductive material having a square shape in cross section parallel to one another;

forming an annular cutting recess on the linear conductive material including ridge lines by semi-circular first pressing surfaces, each semi-circular first pressing surface being formed by cutting out each butt surface, the semi-circular first pressing surfaces being brought into line contact with the ridge lines of the linear conductive material;

forming an annular tapered surface continuous with the cutting recess by second pressing surfaces, each provided along at least one side edge portion of the first pressing surface; and cutting the cutting recess so that a unit-length terminal having a column-shaped protrusion with a tip end surface is cut out.

3. A method for producing a terminal, comprising the steps of:

disposing butt surfaces of a pair of forming dies and side surfaces of a two-unit length linear conductive material having a square shape in cross section parallel to one another;

forming a cutting recess by first pressing surfaces of the pair of the forming dies that are butted against a central portion of the two-unit length linear conductive material having a square shape in cross section to form a cutting recess, wherein each first pressing surface is formed by cutting out each butt surface, and the first pressing surfaces are brought into line contact with ridge lines of the two-unit length linear conductive material;

forming tapered surfaces continuous with the cutting recess; and cutting the cutting recess so that unit-length terminals having a column-shaped protrusion with a tip end surface are cut out.

* * * * *